United States Patent [19]

Hamner et al.

[11] Patent Number: 4,953,639

[45] Date of Patent: Sep. 4, 1990

[54] CLOSED LOOP HYDRAULIC DRILL FEED SYSTEM

[75] Inventors: Jeffrey W. Hamner, Allen; George P. Schivley, Jr., Richardson, both of Tex.

[73] Assignee: Ingersoll-Rand Company, Woodcliff Lake, N.J.

[21] Appl. No.: 404,601

[22] Filed: Sep. 8, 1989

[51] Int. Cl.[5] ..... E21B 19/08

[52] U.S. Cl. ..... 175/203; 60/468; 60/475; 60/476

[58] Field of Search ..... 60/468, 473, 475, 476; 175/203

[56] References Cited

U.S. PATENT DOCUMENTS

| | | | |
|---|---|---|---|
| 2,153,056 | 4/1939 | West | 60/465 |
| 2,457,467 | 12/1948 | Hartman | 60/475 |
| 2,582,556 | 1/1952 | Morey | 62/493 |
| 3,183,668 | 5/1965 | Johnson et al. | 60/371 |
| 3,747,351 | 7/1973 | Wilkerson et al. | 60/476 |
| 3,864,911 | 2/1975 | Gellatly et al. | 60/430 |
| 4,438,628 | 3/1984 | Creamer | 62/476 |

FOREIGN PATENT DOCUMENTS

| | | | |
|---|---|---|---|
| 2706091 | 8/1978 | Fed. Rep. of Germany | 60/475 |

*Primary Examiner*—Ronald C. Capossela
*Attorney, Agent, or Firm*—James R. Bell

[57] ABSTRACT

A closed loop hydraulic system for use in a rotary drilling apparatus includes an extendible-retractable feed cylinder and a valve for biasing the feed cylinder. A variable, reversible displacement pump is provided for pumping fluid from either of the first and second pump ports, including pumping fluid to the feed cylinder. A reservoir retains a supply of fluid for the system. A check valve is provided for supplying additional fluid to the pump in response to the feed cylinder being extended. An overcenter valve is connected to each of the first and second ports for controlling flow from the system in response to pressures received from the first and second ports when the feed cylinder is extended and retracted.

8 Claims, 2 Drawing Sheets

CLOSED LOOP HYDRAULIC DRILL FEED SYSTEM

BACKGROUND OF THE INVENTION

This invention relates generally to power plants having a pressure fluid source and more particularly to a closed loop hydraulic drill feed system.

For drill feed systems in use today, it is common practice to use a hydraulic cylinder with its associated hydraulic system to control feed system movement and force. Because most hydraulic cylinders used in this application exhaust more oil while retracting than they do while extending (unbalanced), the hydraulic circuits used are of the conventional open loop type. For these systems, pump discharge is supplied to a directional control valve which then directs the oil supply appropriately to extend or retract the hydraulic cylinder. In these circuits, oil discharged from the cylinder as a result of cylinder piston movement, returns first to the valve and then back to the system reservoir. Oil supplied to the pump in the first place comes directly from the system reservoir. Because the system reservoir is included in the pumping loop (at the intake of the pump) the system is called an open loop system.

It is evident that, for open loop systems, the characteristic of unequal flows is of little concern because the unbalance is accommodated by the system reservoir. It is this same characteristic, however, that has historically prevented unbalanced cylinders from operating in closed loop (with the reservoir separated from the main pumping loop) drill feed systems.

Previous attempts to operate unbalanced cylinders in closed loops have relied on various controls to replenish the loop, and exhaust oil from the loop, as required by cylinder movement. For example, when the cylinder is extending, the pump receives too little oil back from the cylinder. The use of a check valve to allow oil flow from the reservoir to the pump inlet in this replenishing mode is common practice. Also, when flow in the circuit is reversed and the cylinder is retracting, the cylinder supplies too much oil to the pump. Attempts to return the surplus return oil to the system reservoir have made use of pilot check valves or pilot controlled directional valves. These methods cannot, however, provide the precise position control and stable operation demanded by the drill feed system because these type valves tend to be either open or closed with no flow modulating capabilities.

FIG. 1 illustrates a conventional open loop cylinder feed system with a directional control valve controlling movement of a feed cylinder. The components included in the circuit are a reservoir assembly with a filter and check valves, a pump, the directional control valve, the feed cylinder (unbalanced) and an overcenter valve to provide load holding capabilities. For this circuit, unequal flows produced by cylinder movement are accommodated by the system reservoir. Some types of feed system pumps may even require that inlet oil be at some pressure higher than atmospheric pressure. Methods such as pressurizing the reservoir or boosting inlet oil by other means may be incorporated but the open loop concept remains the same. Supercharge pump pressurization is shown to demonstrate the technique. In this system it is necessary to precisely control the operation of both the directional control valve and pump flow to extend and retract the feed cylinder in an efficient manner. In the absence of automatic controls, the task of operating appropriately is left to the machine operator. It is evident also that the directional control valve contributes to total feed system efficiency loss in both directions of cylinder movement. Another limitation is that filtration capacity must be great enough to accommodate pump flow and pump surplus flow during cylinder retraction.

The foregoing illustrates limitations known to exist in present devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a closed loop hydraulic system including an extendible-retractable feed cylinder and a valve for biasing the feed cylinder. A variable, reversible displacement pump is provided for pumping fluid from either one of first and second ports thereof, including pumping fluid to the feed cylinder. A reservoir retains a supply of fluid for the system. A check valve is provided for supplying additional fluid to the pump in response to the feed cylinder being extended. An exhaust overcenter valve is connected to each of the first and second ports for controlling flow from the system in response to pressures received from the first and second ports.

The foregoing and other aspects will become apparent from the following detailed description of the invention when considered in conjunction with the accompanying drawing figures. It is to be expressly understood, however, that the drawing figures are not intended as a definition of the invention but are for the purpose of illustration only.

DETAILED DESCRIPTION

Figure 1:
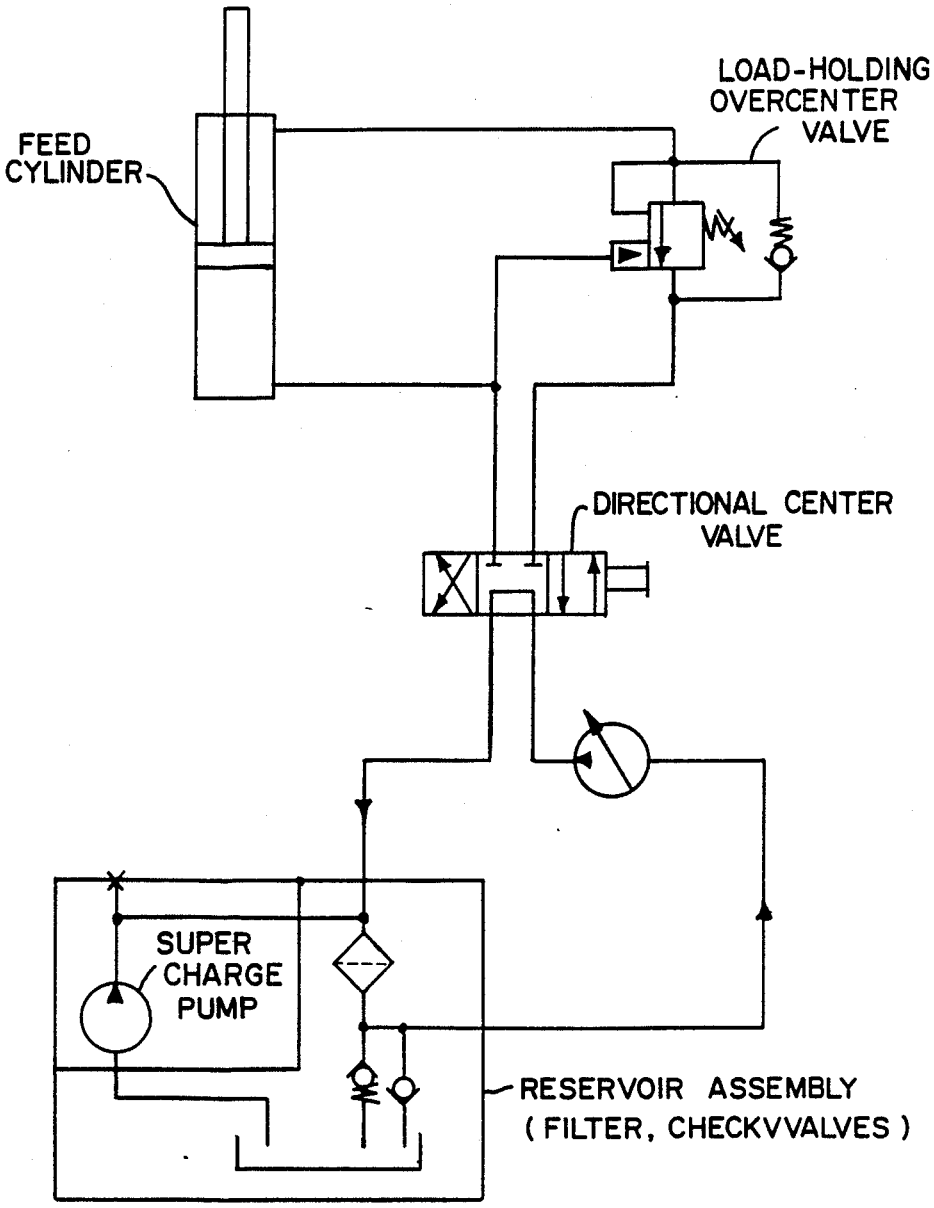
FIG. 1 (PRIOR ART)
FIG. 1 is a schematic view illustrating a conventional open loop system.
Figure 2:
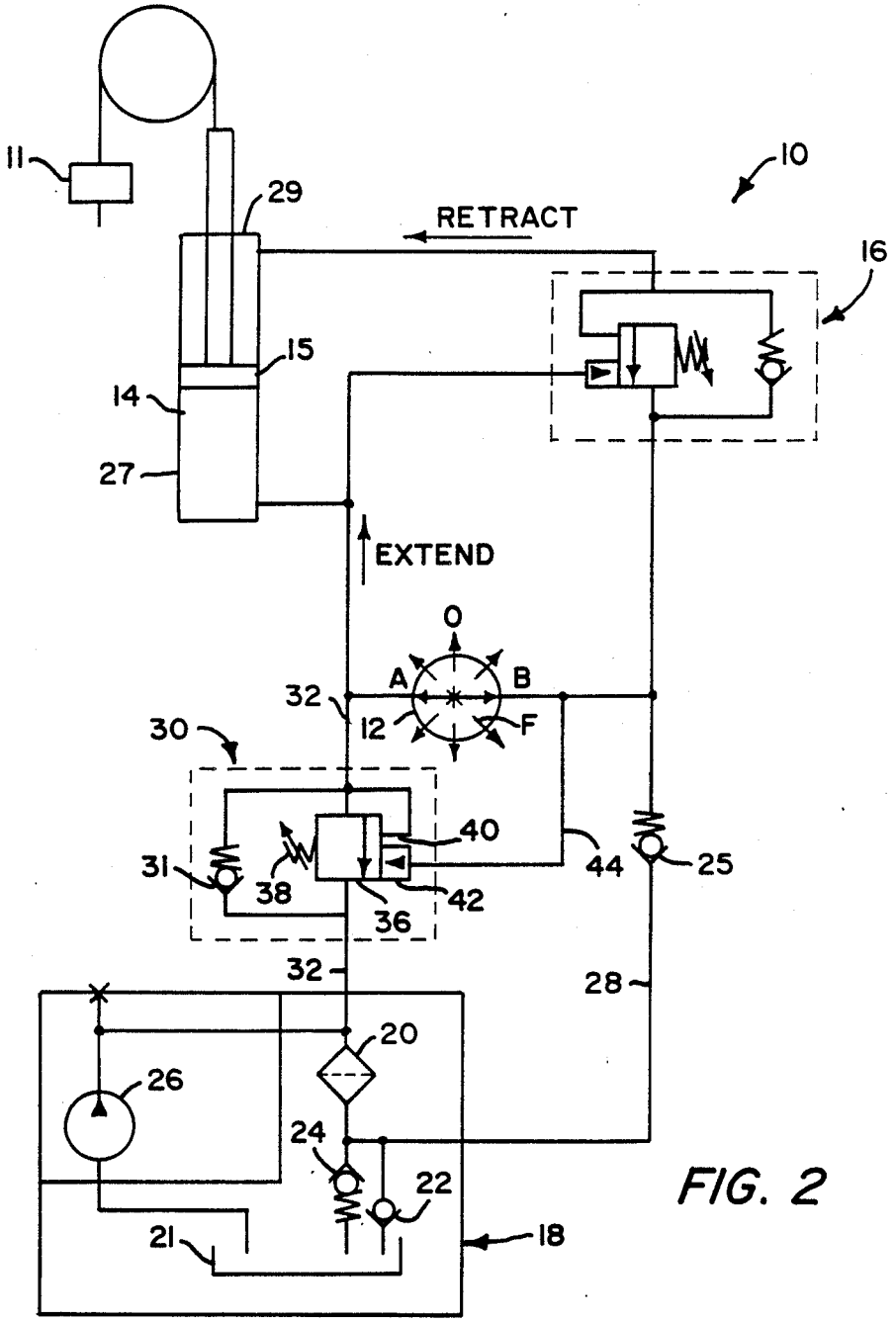
FIG. 2 is a schematic view illustrating an embodiment of the closed loop system of the present invention.

A closed loop, drill feed hydraulic fluid system or circuit for use with a rotary drilling apparatus, is generally designated 10 in FIG. 2. A conventional pump 12, is the same pump as used in the conventional system of FIG. 1, but in the system of FIG. 2, pump 12 functions as a well known variable, reversible displacement pump. As such, pump 12 includes ports A and B and, as is well known, includes a movable cam for controlling fluid flow as indicated by an arrow designated F shown in various positions including a zero position and positions directing fluid to either of ports A or B.

An unbalanced, conventional feed-cylinder 14, includes a piston 15 which is extended and retracted to supply a required movement and force to an associated drill string 11 of which a rotary drilling head is a component. Feed cylinder 14 requires a biasing force to negate a force applied thereto by an associated counterweight comprising the drill string 11. A conventional overcenter valve 16 is provided in system 10 to bias the feed cylinder to negate the counterweight.

A conventional reservoir assembly 18 includes a filter 20, a reservoir 21 and check valves 22, 24, and provides a retainer for a supply of fluid used in system 10. A pump 26 pumps fluid through biased check valve 24 to provide pressurization to reservoir assembly 18.

An inlet (one way) check valve 25 is provided in a conduit 28 between reservoir assembly 18 and port B of pump 12 to supply additional oil to pump 12 when feed cylinder 14 is being extended.

A commercially available overcenter valve 30 is provided in a conduit 32 between port "A" of pump 12 and reservoir assembly 18. Valve 30 includes a valve element 36 spring biased at 38, a port 40, communicating fluid from port A to valve element 36, and a pilot port 42, communicating fluid from port B to valve element 36 via a conduit 44. Valve 30 is available with or without a check valve 31.

The components used from the conventional circuit of FIG. 1, are the reservoir assembly 18, the pump 12, the feed cylinder 14, the overcenter valve 16 for load holding, and the supercharge pump 26 (which, in this illustration, supplies replenishing fluid to the pump during cylinder extension). In this circuit, conduit 28 connects one pump port B to the supercharge pump 26 through the inlet check valve 25. The other pump port A is connected to the reservoir assembly 18 through the overcenter valve 30. The pump 12 shown has a moveable cam for controlling oil flow. The flow rate from such a pump 12 is proportional to the cam angle. When the cam angle is zero, no flow comes from the pump 12. Cam movement controls the direction of flow from either of ports A and B of pump 12.

When the pump 12 is commanded to extend the feed cylinder 14, oil flows from the pump A port to a large end 27 of the feed cylinder 14. Pressure available at A also acts via port 40 against the spring 38 within the overcenter valve 30 to try to force the valve open. Pressure at B communicates, via conduit 44 with the overcenter valve pilot port 42. The pressure here acts at an advantage (pressure x pilot ratio) against the valve spring 38, trying to open the valve element 36. The overcenter valve spring 38 is set sufficiently high that the valve element 36 cannot open due to the influence of the cylinder extend pressure at A and the low return pressure at B. Fluid needed at B due to the unbalanced flow in the system is supplied through the inlet check valve 25 from the supercharge pump 26.

When oil flow is reversed in the system 10 (by appropriate command to the pump 12), the inlet check valve 25 closes and the feed cylinder 14 retracts. Now the pump 12 cannot accommodate the excess flow coming from the large end 27 of the feed cylinder 14. Pressure at B is supplied to a small end 29 of the cylinder 14 and also through pilot conduit 44 to the overcenter valve pilot port 42 where it acts at an advantage against the valve spring 38 to try to open the valve element 36. Pressure on the A side of the hydraulic circuit 10 also acts (without an advantage) against the overcenter valve spring 38 via port 40. The overcenter valve 30 responds to the two control pressures in such a way that it effectively adjusts the pressure at A by directing excess oil to the reservoir assembly 18 in a controlled manner. It is this feature of controlled oil removal in response to the two control pressures, that makes the closed loop system practical for the drill feed application.

While this invention has been illustrated and described in accordance with a preferred embodiment, it is recognized that variations and changes may be made therein without departing from the invention as set forth in the claims.

What is claimed is:

1. A closed loop hydraulic fluid system, comprising:
an extendible-retractable feed cylinder;
variable, reversible displacement pump means for pumping fluid from either one of first and second ports thereof including pumping fluid to the feed cylinder;
reservoir means for retaining a supply of fluid for the system;
check valve means for supplying additional fluid to the pump means in response to the feed cylinder being extended; and
overcenter valve means connected to each of the first and second ports controlling flow from the system in response to pressures received from the first and second ports.

2. The system as defined in claim 1, further including:
supercharge pump means for pressurizing the reservoir means.

3. The system as defined in claim 2, wherein the overcenter valve means is connected between the pump means and the reservoir means.

4. The system as defined in claim 3, wherein the overcenter valve means has a port connected to the first pump port and a pilot port connected to the second pump port.

5. The system as defined in claim 3, wherein the check valve means is connected between the reservoir means and the second port.

6. The system as defined in claim 1, further including:
valve means for biasing the feed cylinder.

7. A closed loop, drill feed hydraulic system for a rotary drilling apparatus, comprising:
a drill string;
extendible-retractable feed cylinder means for supplying a force to the drill string;
variable, reversible displacement pump means for pumping fluid from either one of first and second ports thereof including pumping fluid to the feed cylinder means;
reservoir means for retaining a supply of fluid for the system;
check valve means for supplying additional fluid to the pump means in response to the feed cylinder means being extended; and
overcenter valve means connected to each of the first and second ports for controlling flow from the system in response to pressures received from the first and second ports when the feed cylinder means is extended and retracted.

8. The system as defined in claim 7, further including:
valve means for biasing the feed cylinder.

* * * * *